US005502609A

United States Patent [19]

Thomas et al.

[11] Patent Number: 5,502,609

[45] Date of Patent: Mar. 26, 1996

[54] ELECTRIC CIRCUITRY FOR PREVENTING CONTACTOR TIP CONTAMINATION IN DRY SWITCHING APPLICATIONS

[75] Inventors: Sherrill G. Thomas, Sutherlin, Va.; Larry G. Ball, Snow Camp, N.C.

[73] Assignee: General Electric Company, Fort Wayne, Ind.

[21] Appl. No.: 352,417

[22] Filed: Dec. 8, 1994

[51] Int. Cl.[6] ..... H01H 1/6

[52] U.S. Cl. ..... 361/6; 361/4; 361/196; 307/137; 307/10.6; 307/10.7

[58] Field of Search ..... 361/3, 4, 6, 156, 361/196; 307/141, 137, 10.6, 10.7, 10.8

[56] References Cited

U.S. PATENT DOCUMENTS 3,656,045 4/1972 Frezzolini et al. ..... 307/10.7
3,774,082 11/1973 Chang .
3,993,914 11/1976 Conrad et al. ..... 307/10.8

*Primary Examiner*—Todd DeBoer
*Attorney, Agent, or Firm*—Ralph E. Krisher, Jr.

[57] ABSTRACT

A contactor control system for a DC electric power system for reducing contactor tip contamination from dry-switching includes a first switch connected in circuit between a power source and a controller for enabling the controller upon closure of the first switch. A PTC resistor is connected between the first switch and a filter capacitor whereby charging current is supplied to the capacitor upon closure of the first switch. A solid-state switch is connected in series circuit with an electromagnetic actuator of a contactor having power contact tips in circuit between the power source and a load. The series combination of the actuator and solid-state switch is connected in parallel circuit with the filter capacitor. The controller is operable to gate the solid state switch into conduction when voltage on the capacitor exceeds a preselected voltage whereby discharge current from the capacitor is effective to energize the actuator for closing the contact tips such that voltage on the capacitor is less than the source voltage at contactor closure to affect a current through the contactor at closure.

5 Claims, 1 Drawing Sheet

ELECTRIC CIRCUITRY FOR PREVENTING CONTACTOR TIP CONTAMINATION IN DRY SWITCHING APPLICATIONS

BACKGROUND OF THE INVENTION

The present invention relates to electrical contactors and, more particularly, to a method and apparatus for reducing oxide contamination on contactor tips used in no-load power switching applications. There are numerous applications in which electrical contactors are used to isolate an electrical circuit from an electrical power source. In many of these applications, the contactor is operated in what is sometimes referred to as a dry-switching mode, i.e., in a mode in which no current is drawn through the contactors' tips at the time of opening or closing. For example it is common to use a key switch controlled contactor in electrical vehicles to isolate the battery from the electric traction motor and associated control when the key switch is turned to an off position.

While there are advantages to operating a contactor in a dry switching mode, such as, for example, to extend contactor tip life by eliminating arcing, there is also a significant disadvantage. In particular, contactor tips, typically produced from a silver based metal, will form a surface oxide or sulfide which has poor electrical conductivity and acts as an electrical insulator at such tips. In some instances the oxide or sulfide may accumulate sufficiently to block current flow to the electrical system while a lesser accumulation may reduce available power to the system.

One method of avoiding oxide and sulfide build-up is to construct contactors in which the tips exhibit a wiping action during operation, i.e., a moving tip rubs across a surface of a stationary tip to wipe the oxide from the tip. A disadvantage of such contactors is their relatively high cost in comparison to conventional contactors. Accordingly, it is desirable to develop a means for preventing oxide and sulfide build-up on contactor tips which does not require special contactors.

SUMMARY OF THE INVENTION

Among the several objects of the present invention may be noted the provision of a method and apparatus for assuring contact closure with controlled current to prevent dry-switching; a method and apparatus for closing contacts with an applied voltage less than maximum contactor controlled voltage; and a method and apparatus for assuring contact opening on demand.

In an illustrative form, the invention comprises a contactor control system for a DC electric motor power system for reducing contactor tip contamination from dry-switching. The power system includes a DC power source coupled to a motor through a normally open line contactor, an electronic motor controller coupled in circuit with the motor and a line filter capacitor coupled in parallel circuit arrangement with the motor and controller. The contactor control system includes a first switch connected in circuit between the power source and the controller for enabling the controller upon closure of the first switch. A PTC resistor is connected between the first switch and the capacitor whereby charging current is supplied to the capacitor upon closure of the first switch. An electromagnetic actuator for the line contactor and a solid-state switch are connected in series circuit and this series combination is connected in parallel circuit with the capacitor.

The controller is operative for gating the solid state switch into conduction when voltage on the capacitor exceeds a preselected voltage whereby discharge current from the capacitor is effective to energize the actuator for closing the line contactor. Since the capacitor discharges to energize the contactor, the voltage on the capacitor is less than the source voltage at contactor closure to affect a current through the contactor at closure.

The contactor control system also includes a second switch connected in series circuit with the electromagnetic actuator, the second switch being mechanically coupled to the first switch for concurrent operation therewith, whereby opening of the second switch occurs concurrently with opening of the first switch for removing power to the actuator upon opening of the first switch.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
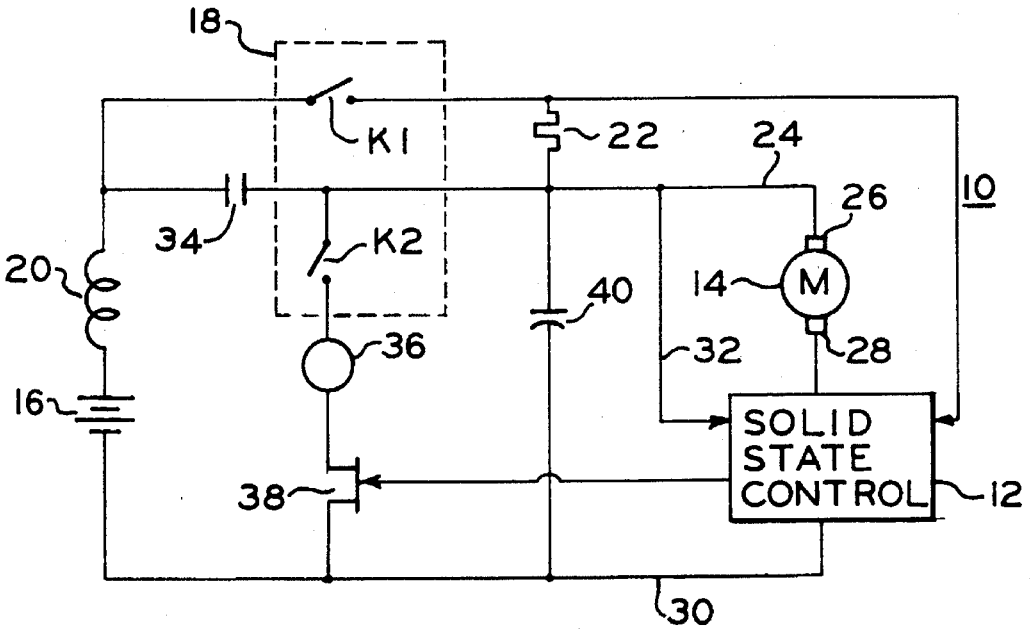
FIG. 1 illustrates a motor power system incorporating the present invention.

Referring to FIG. 1, there is shown an exemplary form of an electrical power control system 10 incorporating the method and apparatus of the present invention. The basic control system includes a solid state controller 12, which may include a conventional pulse width modulated (PWM) controller of a type well known in the art, coupled in circuit with a direct current (DC) electric drive motor 14. Electric power is supplied from a DC source 16, illustrated as a battery in this embodiment.

As will be apparent, the controller 12 is intended to represent all of the elements of a power system necessary to control operation of motor 14. In this regard, the controller block 12 encompasses a regulated power supply, a speed control (and accelerator, if used) and suitable control logic for regulating motor operation. An example of a controller which could be used in block 12 is shown in U.S. Pat. No. 4,730,151 assigned to General Electric Company.

In a typical application, such as, for example, a small hand truck, a key switch or other manually controlled switch indicated at 18 includes a pair of contact sets K1 and K2. Contact set K1 is serially coupled between power source 16 and controller 12, although it is common to include a small inductive reactor 20 of, for example, 6 microHenries, in series with the source 16 and switch 18 as shown in order to reduce in-rush current during switching. When contact sets K1 close, current is coupled to controller 12 for activating the incorporated power regulator and control circuits of the controller.

Closing of contact set K1 also couples power to a positive temperature coefficient (PTC) resistor 22, which resistor is connected between contact sets K1 and a positive voltage bus 24. Bus 24 connects to one terminal 26 of motor 14. A second terminal 28 of motor 14 is connected to a power control terminal of controller 12. The system 10 also includes a relatively negative power bus 30 connected to a negative terminal of source 16 and a return terminal of controller 12. Controller 12 senses the voltage on bus 24 via line 32.

Power to bus 24 is supplied from source 16 through reactor 20 and a serially connected line contactor 34. Contactor 34 represents the actuatable contact pair of an electromagnetic contactor actuated by current applied to an electromagnetic coil 36. Coil 36 is connected in series circuit with contact set K2, which contact set K2 is connected to positive bus 24. A solid state switch 38 is also connected in series circuit with coil 36 between coil 36 and negative bus 30. Switch 38 may be a transistor switch such as a power MOSFET, a gate turn-off (GTO) device, or a thyristor. A capacitor 40 is connected between bus 24 and bus 30 and, in addition to functioning as a line filter capacitor of relatively large size (about 20000 MFD), also functions to affect operation of contactor 34 in such a manner as to reduce oxide and sulfide formation on the contactor tips.

Figure 2:
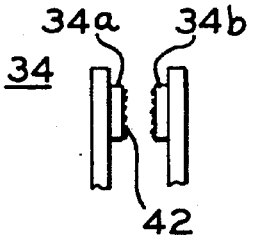
FIG. 2 is a view of contactor tips showing oxide build-up.

Referring briefly to FIG. 2, contactor 34 is shown to include a pair of contactor tips 34*a*, 34*b* which, when brought into contact tip closure, provide a current path for current from source 16 to bus 24. If the contact tips are normally operated in a "dry-switching" mode, i.e., with no current through the contactor, the tips tend to oxidize and form a surface layer 42 of an oxide or sulfide compound which may have high electrical resistivity. Such an oxide build-up can reduce the power available to bus 24 and may eventually prevent current flow through the contactor.

Applicant's invention minimizes oxide formation on contact tips 34*a*, 34*b* by assuring that some limited amount of current flows through the tips as they are closed. The current is sufficient to "clean" the tips without being so large as to burn the tips by drawing a large arc.

Referring again to FIG. 1, when key switch 18 is actuated, contact sets K1 and K2 close. Power is supplied to controller 12 through set K1 so that controller 12 is powered up to sense the voltage on bus 24 and is ready to control power to motor 14. Closure of contact set K1 also couples current to bus 24 through PTC resistor 22. The PTC resistor 22 limits the current through contact set K1 but allows sufficient current to begin charging capacitor 40. While contact set K2 is also closed, no current yet flows in through set K2 since switch 38 is not yet conductive.

The controller 12 monitors the voltage on bus 24 via line 32 and when the voltage reaches a predetermined level, which may be at about battery 16 voltage, the controller provides a gating signal to switch 38 causing it to become conductive and complete the current path from bus 24 to bus 30. Since contactor 34 is not yet closed, current to coil 36 is initially supplied from capacitor 40, discharging capacitor 40 so that the voltage on bus 24 falls below the voltage of source 16. When the current through coil 36 then causes contactor 34 to close, current is drawn through the contactor to quickly recharge capacitor 40.

Since the charge on capacitor 40 is used to energize coil 36, the voltage on capacitor 40 will always be less than the voltage of source 16 when contactor 34 closes. Accordingly, current will always flow between contactor tips 34*a*, 34*b* at contactor closure. However, since there will be a calculatable level of voltage on capacitor 40, the current through contact tips 34*a*, 34*b* can be controlled to be less than a value which would cause contact tip deterioration. The current is determined by the resistance of coil 36, the magnitude of battery voltage and the capacitance value of capacitor 40.

It will be recognized that contact set K2 is not necessary to implementation of the system to assure current in contactor 34 at contact closure. However, contact set K2 is used to immediately remove power from coil 36 when key switch 18 is switched to an off position. Without K2, capacitor 40 would continue to apply power to coil 36 keeping contactor 34 closed until the capacitor discharges below the coil holding point voltage. The contact set K2 thus assures that contactor 34 opens immediately when switch 18 is switched to an off position.

Figure 3:
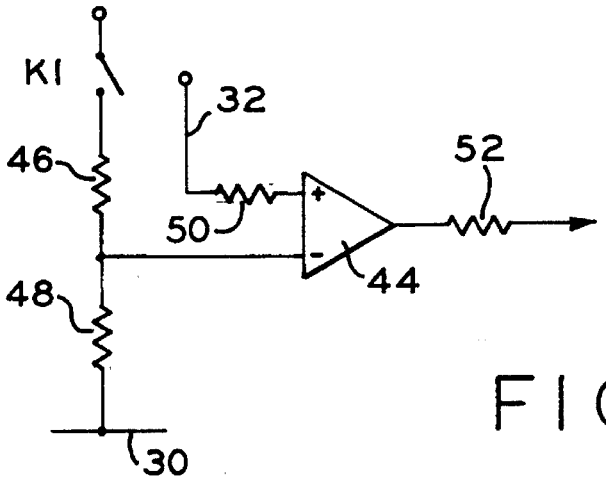
FIG. 3 illustrates one form of gating circuit used in the present invention.

Referring to FIG. 3, there is shown one form of circuit for developing a gating signal to switch 38. This circuit includes a comparator 44 having an inverting input terminal coupled to a voltage divider comprising resistors 46,48. Resistor 46 is connected to switch K1 for receiving battery 16 voltage while resistor 48 connects to negative bus 30. The value of resistors 46,48 are selected to provide a voltage close to battery voltage to the inverting input terminal. The non-inverting input terminal is connected through a resistor 50 to sense line 32. When the voltage on sense line 32 exceeds the reference voltage set by resistors 46,48, the comparator 44 generates a gating signal which is coupled through a resistor 52 to a gate terminal of solid-state switch 38. The switch 38 may be a type that remains in conduction until current through it drops below a holding current, such as a thyristor, or a separate logic circuit (not shown) responsive to comparator 44 may maintain the gating signal until power is removed.

In an exemplary embodiment, in which the applied battery voltage is 16 volts, it has been found that closing of the contacts 34 with a voltage of 12 volts on capacitor 40 is sufficient to provide a minimum current at contact closure. That level of voltage differential with capacitor 40 having a value of 20000 MFD will produce about 80 amperes or less of contactor current and is effective to keep the contacts form oxidizing or otherwise forming an insulative surface layer.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A contactor control system for a DC electric motor power system for reducing contactor tip contamination from dry-switching, the power system including a DC power source coupled to a motor through a normally open line contactor, an electronic motor controller coupled in circuit with the motor and a line filter capacitor coupled in parallel circuit arrangement with the motor and controller, the control system including:

a first switch connected in circuit between the power source and the controller for enabling the controller upon closure of said first switch;

resistance means connected between said first switch and the capacitor whereby charging current is supplied to the capacitor upon closure of said first switch;

an electromagnetic actuator for the line contactor;

a solid-state switch connected in series circuit with said electromagnetic actuator, the series combination of said actuator and solid-state switch being connected in parallel circuit with the capacitor; and means in the controller for gating said solid state switch into conduction when voltage on the capacitor exceeds a preselected voltage whereby discharge current from the capacitor is effective to energize said actuator for closing the line contactor such that voltage on the capacitor is less than the source voltage at contactor closure to affect a current through the contactor at closure.

2. The contactor control system of claim 1 and including a second switch connected in series circuit with said electromagnetic actuator, said second switch being mechanically coupled to said first switch for concurrent operation therewith, whereby opening of said second switch occurs concurrently with opening of said first switch for removing power to said actuator upon opening of said first switch.

3. The contactor control system of claim 1 wherein said means for gating comprising a comparator circuit for comparing said capacitor voltage to a reference voltage and for generating a gating signal when said capacitor voltage exceeds said reference voltage.

4. A method for preventing contact tip contamination from dry-switching of a line contactor having at least one pair of normally open contact tips for coupling, when closed, a source of DC electric power to a load and an electric load controller, the contact tips being closed by actuation of an electromagnetic actuator operatively associated therewith, the method comprising the steps of:

coupling a line filter capacitor in parallel with the load and controller;

charging the capacitor from the power source prior to closure of the contact tips; and connecting the charged capacitor in circuit with the electromagnetic actuator for actuation thereof whereby the contact tips are closed with a charge on the capacitor less than a voltage of the power source to thereby cause a current flow from the source to the capacitor at contact tip closure.

5. The method of claim 4 and including the further steps of:

monitoring voltage on the capacitor prior to contact tip closure; and effecting connection of the capacitor to the electromagnetic actuator when the capacitor voltage reaches substantially the value of the source voltage.

* * * * *

UNITED STATES PATENT AND TRADEMARK OFFICE

CERTIFICATE OF CORRECTION

PATENT NO. : 5,502,609

DATED : March 26, 1996

INVENTOR(S) : Thomas et al.

It is certified that error appears in the above-identified patent and that said Letters Patent is hereby corrected as shown below:

ON THE TITLE PAGE:

Title of the invention at item [54] and Col. 1, line 1-3; should read --

ELECTRICAL CIRCUITRY FOR PREVENTING CONTACTOR TIP CONTAMINATION IN DRY SWITCHING APPLICATIONS

--.

Signed and Sealed this

Twenty-ninth Day of October 1996

*Attest:*

Bruce Lehman

BRUCE LEHMAN

*Attesting Officer*

*Commissioner of Patents and Trademarks*